US008684164B2

(12) United States Patent
Poloni et al.

(10) Patent No.: US 8,684,164 B2
(45) Date of Patent: Apr. 1, 2014

(54) DEVICE AND PROCESS FOR FORMING ROLLED BAR BUNDLES

(75) Inventors: Alfredo Poloni, Fogliano Redipuglia (IT); Giuseppe Bordignon, Bicinicco (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 839 days.

(21) Appl. No.: 12/736,065

(22) PCT Filed: Mar. 5, 2009

(86) PCT No.: PCT/IB2009/050899

§ 371 (c)(1),
(2), (4) Date: Oct. 14, 2010

(87) PCT Pub. No.: WO2009/109929

PCT Pub. Date: Sep. 11, 2009

(65) Prior Publication Data

US 2011/0016940 A1 Jan. 27, 2011

(30) Foreign Application Priority Data

Mar. 6, 2008 (IT) ..... MI2008A0373

(51) Int. Cl.
*B21C 49/00* (2006.01)
*B21F 3/02* (2006.01)

(52) U.S. Cl.
CPC .. *B21C 49/00* (2013.01); *B21F 3/02* (2013.01)
USPC ..... 198/418.6; 198/560; 414/745.9; 414/746.4; 414/791.6; 53/536; 53/444

(58) Field of Classification Search
USPC ..... 198/418.6, 418, 431, 432, 433, 530, 198/532, 550.4, 560; 414/745.9, 746.1, 414/746.2, 746.4, 791.6; 53/536, 444
See application file for complete search history.

(56) References Cited

U.S. PATENT DOCUMENTS

| | | | | |
|---|---|---|---|---|
| 3,718,062 | A * | 2/1973 | Gilvar | 83/268 |
| 4,147,258 | A * | 4/1979 | Kaplan | 414/680 |
| 4,174,662 | A * | 11/1979 | Klusmier | 100/7 |
| 4,439,099 | A * | 3/1984 | Asari et al. | 414/790 |
| 4,820,101 | A * | 4/1989 | Fenn | 414/21 |
| 5,222,859 | A * | 6/1993 | Gepfert et al. | 414/794.3 |
| 5,956,928 | A * | 9/1999 | Bordignon et al. | 53/444 |
| 6,752,073 | B1 * | 6/2004 | Paris | 100/212 |

FOREIGN PATENT DOCUMENTS

| | | |
|---|---|---|
| CN | 200970620 | 11/2007 |
| DE | 10103677 | 8/2002 |

* cited by examiner

*Primary Examiner* — Mark A Deuble
(74) *Attorney, Agent, or Firm* — Stetina Brunda Garred & Brucker

(57) ABSTRACT

A device (1) for forming rolled bar (3) bundles which allows to obtain perfectly tidy and super compact bundles, in which the bars (3) are perfectly aligned with one another without twisting, tangling or overlapping, both inside and outside the bundle, conferring an excellent shape and regular appearance to the same. A process for forming rolled bar bundles by using the aforesaid device is also described.

15 Claims, 8 Drawing Sheets

DEVICE AND PROCESS FOR FORMING ROLLED BAR BUNDLES

FIELD OF THE INVENTION

The present invention relates to a device for forming rolled metal profile bundles, e.g. round-section bars, and to the process thereof.

STATE OF THE ART

Devices adapted to form bar bundles downstream of the cooling zone arranged at the outlet of a rolling mill are known; in such devices, the bars are fed by means of continuous conveyors, firstly onto lance or arm means and then, from the same lance or arm means, are left to fall in open order and from a considerable height (30-50 cm) into the accumulation seat underneath. Untidy, uncontrolled movements of the bars are thus determined, causing twisting and/or overlapping of the same, forming untidy bundles, which are not very compact and visually low in quality.

A bar bundle of this type slows down downstream machining operations, e.g. processes which include making electrically welded metal nets or brackets. Indeed, bundle unraveling operations are often needed to extract the bars, and straightening operations are needed to eliminate bending and twist of severely deformed bars.

A further disadvantage of the known devices for forming bar bundles is the down-times expected in the bundle forming cycle. Indeed, interruptions of feeding the rolled bars onto the depositing lances are provided in order to complete the previously formed bundle evacuation.

It is thus felt the need to make a device for forming rolled bar bundles which allows to overcome the aforesaid drawbacks.

SUMMARY OF THE INVENTION

The primary object of the present invention is to provide a device for forming continuously fed rolled bar bundles, which allows to obtain bundles in which the bars are perfectly aligned with one another without twisting, tangling and overlapping both inside and outside the bundle, conferring to the same bundle an excellently shaped and regular appearance.

Another object of the invention is to provide a process for continuously forming rolled bar bundles by using the aforesaid device.

Therefore, the present invention proposes to reach the above-discussed objects by making a device for forming a rolled bar bundle, suitable for cooperating with an end of a conveyor of said bars, the conveyor defining a first plane, the device comprising in accordance with claim 1

- a plurality of transversal supporting elements, arranged on a second plane and parallel to one another,
- moving means adapted to move the plurality of transversal supporting elements along said second plane from a first receiving position, in order to receive a predetermined number of bars for forming a layer of bars, to a second unloading position, in order to unload said layer of bars onto accumulation means, at a speed such to prevent the bars resting on said supporting elements from being dragged,
- first containing means of said layer of bars cooperating with said plurality of supporting elements, wherein the second plane is inclined by a predetermined angle with respect to said first plane.

A second aspect of the present invention provides a process for forming rolled bar bundles by using the aforesaid device which, in accordance with claim 11, comprises the following stages:

- providing the plurality of transversal supporting elements in the first receiving position;
- receiving a predetermined number of bars on said second plane for forming one layer of bars, the bars being fed at least one at a time by means of the conveyor with a first predetermined time interval between the feeding of at least one bar and the feeding of at least one subsequent bar;
- moving said plurality of supporting elements from the first receiving position to the second unloading position, for unloading said layer of bars on the accumulation means, and from this second position back to the first receiving position in a second time interval shorter than the first interval.

The device and process of the invention advantageously allow to obtain compact, tidy finished bar bundles which are characterized by a high filling coefficient.

Furthermore, by virtue of the above-mentioned features, the invention also allows to obtain the following advantages:

- the down-times in the bundle forming cycle are cancelled by simultaneously feeding the bars onto the lances and continuously evacuating the already formed bundle;
- the straightness of the bars within the bundle is ensured;
- the tidy arrangement of the bars and their straightness allow to speed up and simplify the operations in downstream machining processes, for example processes which provide the implementation of electrically welded metal nets or brackets, because the extraction of each single bar from the bundle is facilitated;
- the bundles remain geometrically regular even after the binding operation;
- down-times and costs related to the bundle unraveling and bar straightening operations are completely cancelled.

The bar bundle forming device and process, object of the present invention, are preferably applied downstream of the hot rolling mills for the bars regardless of the bar packaging system. Advantageously device and process are used for packing bundles of round-section bars, with ribs for the use in reinforced concrete or smooth intended for drawing, for example.

The bars which may be advantageously packed by the device of the invention preferably have a diameter ranging from 6 mm to 32÷40 mm and a length of 6÷18 meters.

The dependent claims describe preferred embodiments of the invention.

BRIEF DESCRIPTION OF THE DRAWINGS

Further features and advantages of the invention will be more apparent in the light of the detailed description of preferred, but not exclusive, embodiments of a bar bundle forming device illustrated by the way of non-limitative example, with the aid of the accompanying drawings, in which.

DETAILED DESCRIPTION OF PREFERRED EMBODIMENTS OF THE INVENTION

Figure 1:
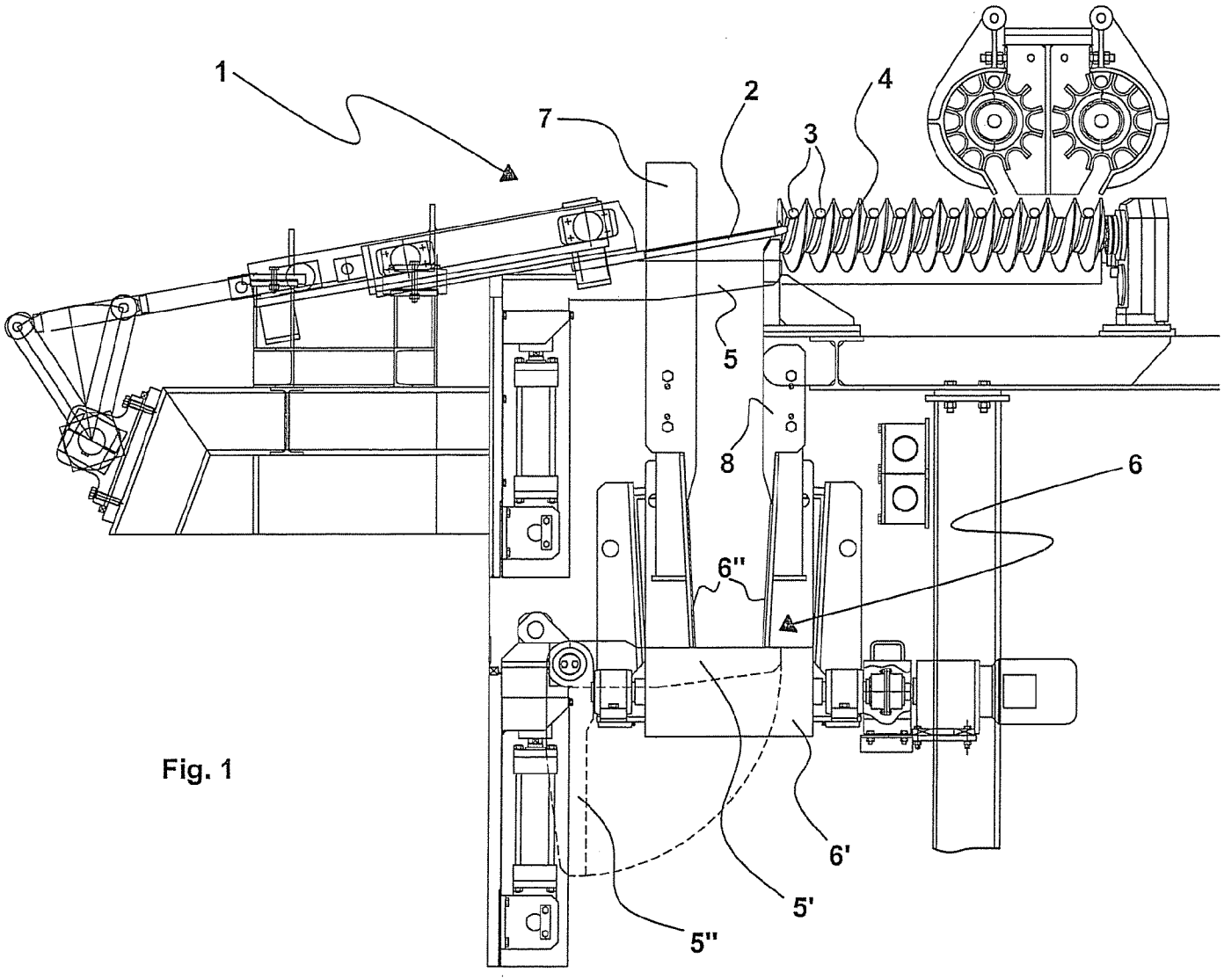
FIG. 1 is a side view of the device according to the invention cooperating with a first conveyor embodiment.
Figure 2:
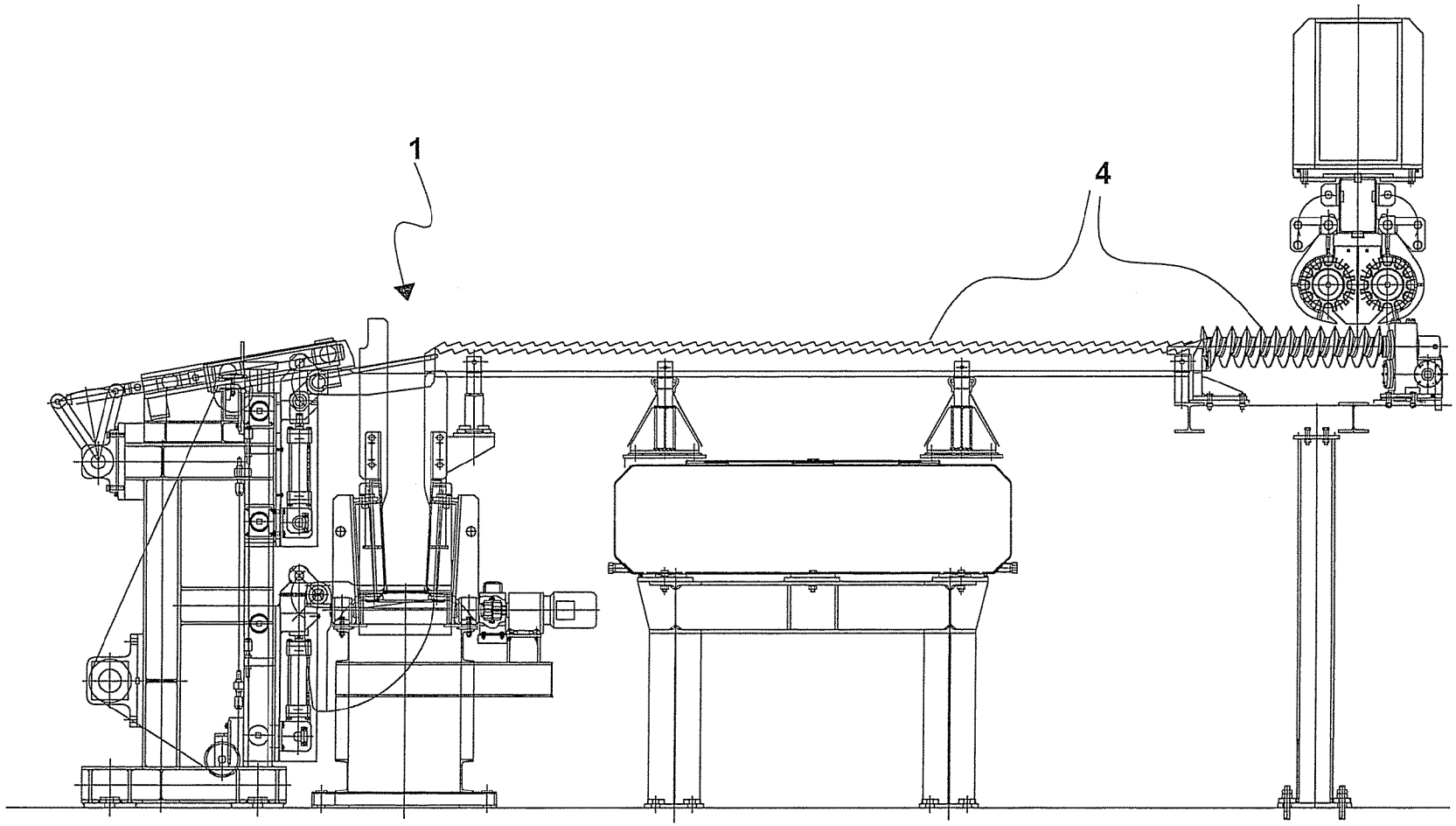
FIG. 2 is a side view of the device according to the invention cooperating with a second conveyor embodiment.

FIG. 1 shows a side view of part of a rolling system for metal round-section, smooth or ribbed bars comprising a bundle forming device according to the present invention.

Such a bundle forming device, globally indicated by reference numeral 1, cooperates with the end part of the area for moving and unloading the rolled bars 3, arranged downstream of a rolling mill.

The device comprises lance or arm means 2 adapted to collect the bars 3 which are fed from the terminal end of the conveyor 4 and then to unload them over a movable bag 5 underneath. The lance means, or simply depositing lances 2, are arranged with their longitudinal axis substantially orthogonal to the axis of the bars close to the terminal end of the conveyor. Said depositing lances 2 according to a transversal view with respect to the rolling axis, are placed on a slightly inclined plane with respect to the horizontal plane on which the conveyor 4 lays.

The depositing lances 2 are advantageously inclined with respect to said horizontal plane by a predetermined angle $\alpha$ and are provided with an advancement/retraction movement along their longitudinal axis by means of appropriate kinematic mechanisms, for example of the rod-crank type. Other mechanisms of hydraulic or pneumatic type may be provided. Each lance 2 has a substantially trapezoidal cross-section with respect to its axis, with the smaller base facing upwards so as to minimize the contact surface with the bar resting thereon.

Figure 5:
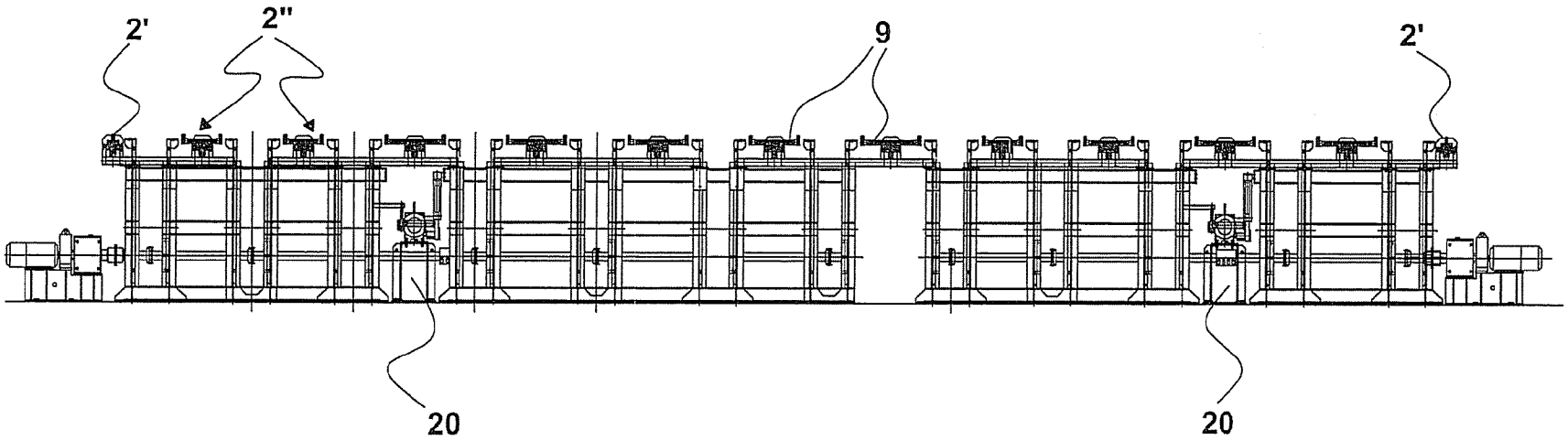
FIG. 5 is a side view of the bundle forming device of the present invention according to a plane parallel to the rolling axis.

According to a side view parallel to the rolling axis, shown in FIG. 5, the depositing lances 2 are arranged spaced out at a predetermined distance from one another in order to support the rolled bars 3 from the head to the tail along their whole longitudinal extension. Specifically, single lances 2' are provided at the head and tail of the bars, respectively, while in the intermediate segments of the device 1, the lances are mounted in pairs 2" on a common frame 9. The actuating motors 20 of the aforesaid kinematic mechanisms or mechanisms are shown in FIG. 5.

Figure 4:
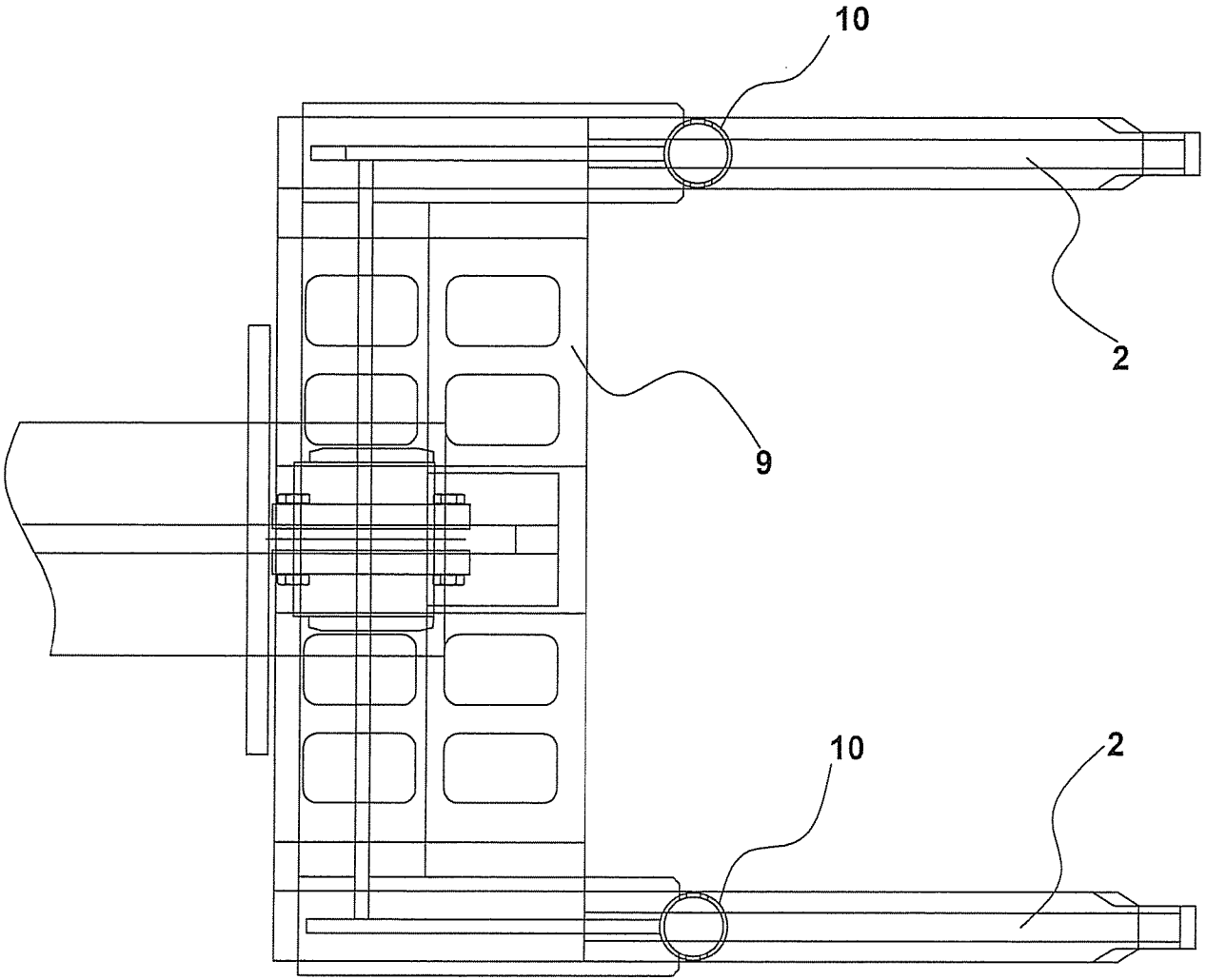
FIG. 4 is a top view of a module belonging to the device of the invention.

FIG. 4 shows a top view of a pair of depositing lances 2 mounted to the common frame 9.

Said predetermined distance between the lances of the same pair and between two consecutive lances of two adjacent pairs is advantageously not too high, preferably ranging from 0.5 to 1 m.

Indeed, because the residual temperature of the bar is still rather high, ranging from about 200° C. to about 650° C., longitudinal deformations of the bar are generated with the formation of one or more loops between the resting points, i.e. between the lances, which may deteriorate the straightness of the bar. As the value of the deflection of the bar segment between two rests depends, other than on the residual temperature of the unloaded bar, also on the diameter of the bar and the distance between the rests, for this reason the value of such an deflection may be maintained as low as possible by choosing the aforesaid predetermined distance between the two lances 2, so that the bar has a better straightness during the step of forming the bundle for the benefit of the final quality of the bundle itself.

A further advantage of the device of the invention is the provision of suitable lubrication means for the upper surface of the lances 2.

Figure 3:
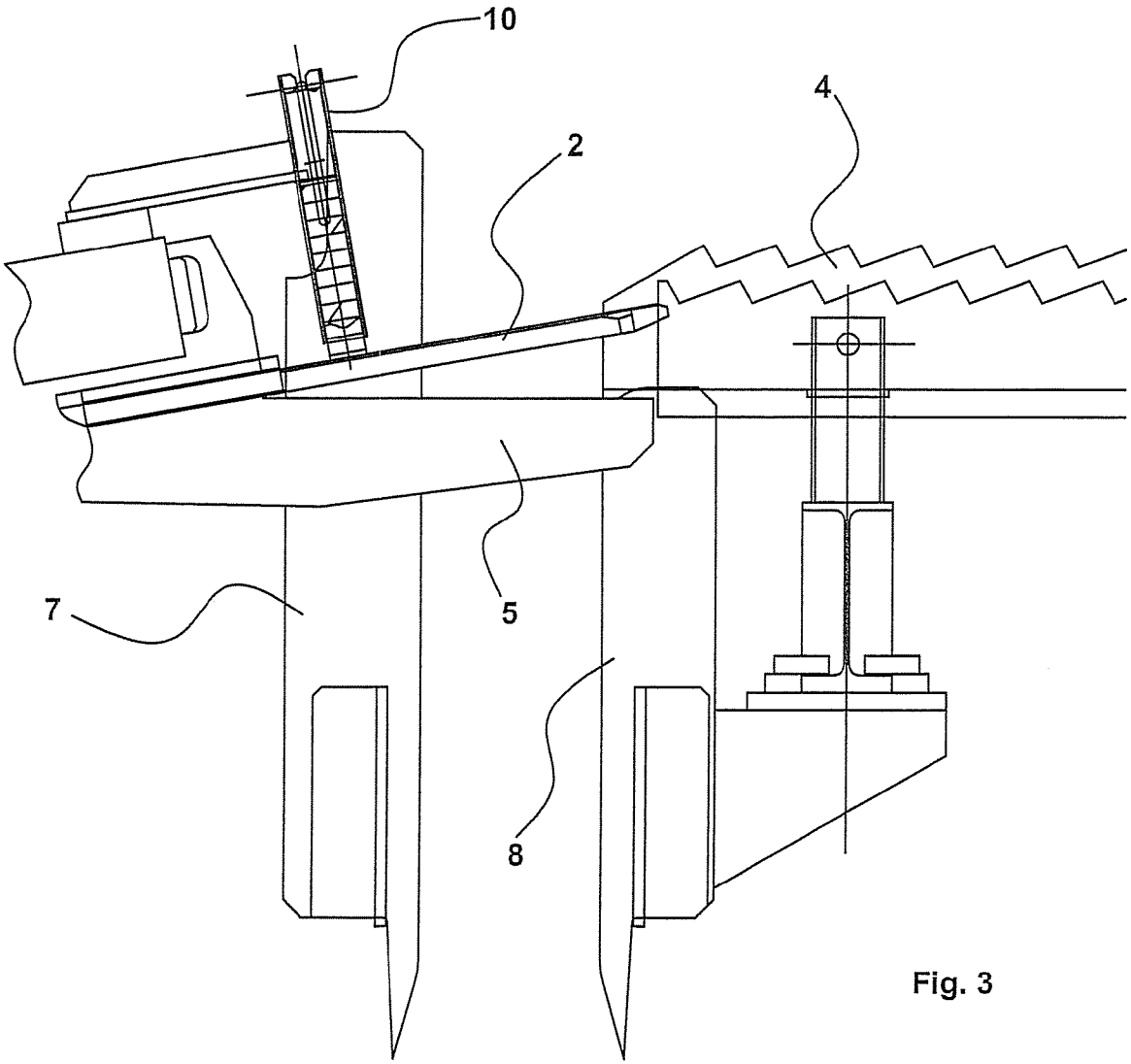
FIG. 3 is a side view of some components of the device according to the invention.

In a preferred embodiment, for each lance 2 there is provided an applicator 10 of a lubricant substance consisting, for example, of a solid graphite cylinder (FIG. 3), which by virtue of a counterweight remains constantly in contact with the surface to be lubricated. During the retraction movement of the lance, described below, the graphite is cyclically and uniformly deposited on the whole upper surface of the lance.

Lubrication facilitates the rolling of the first bar around its axis, unloaded onto the lances 2, which reaches the base of the inclined plane defined by the upper surfaces of the lances themselves, and the rolling of the subsequent unloaded bars around its axis so that they are arranged side-by-side in a perfect reciprocal contact to form a uniform, tidy layer on said inclined plane.

The inclination angle $\alpha$ of the laying plane of the depositing lances 2 with respect to the horizontal laying plane of the conveyor 4 is advantageously chosen so as to ensure the complete and uniform descent of the bars and avoid the bars from tangling at the base of this inclined plane.

Said angle $\alpha$ advantageously ranges from about 1° to 20°, it is preferably equal to 10°, value at which the best results were obtained.

The movable bag 5, provided in a starting position just underneath the depositing lances 2, comprises a plurality of horizontal resting surfaces which are reciprocally spaced out, each resting surface being preferably at a respective lance. The bag 5 cooperates with a first vertical backing 7 and with a second vertical backing 8, opposite to the first backing, substantially placed below the terminal end of the conveyor 4. The two-backings 7, 8, both fixed, contain the layers being formed on the bag, preventing undesired transversal movements of the bars, and also contain the finished bar bundle during transferring the bars from bag 5 to the roller table 6 underneath.

The roller table 6 consists of motorized horizontal rollers 6' and idle vertical rollers 6"; the resting surfaces of the bag 5, passing through the gap between the horizontal motorized rollers 6', rest the bundle on said rollers 6'. Once the bar bundle has been received, the motorized rollers 6' evacuate it by sending it to the binding area of the bar packaging apparatus. Further roller tables for transferring the bound bundles, a weighing station and groups of collecting and accumulating bags of the bound bundles may be provided downstream of the binding area.

The bar bundle forming cycle includes, according to the invention, a step of depositing the single bar layers on the lances 2, suspended by steps of unloading and accumulating each single bar layer on the movable bag 5 underneath. Said movable bag 5 is arranged immediately underneath the deposit lances 2, in said starting position, and receives a layer of bars 3 cyclically released by the lances themselves: the bundle of bars, consisting of bars arranged perfectly side-by-side and adjacent to one another, is formed by means of the subsequent overlapping of the layers on the movable bag.

The falling height of the bars from the lances 2 to the bag 5 is advantageously very small; a small difference of level indeed allows to prevent the bars from bouncing while landing, and thus to prevent the risk of tangling and overlapping of the bars themselves.

Figure 8:
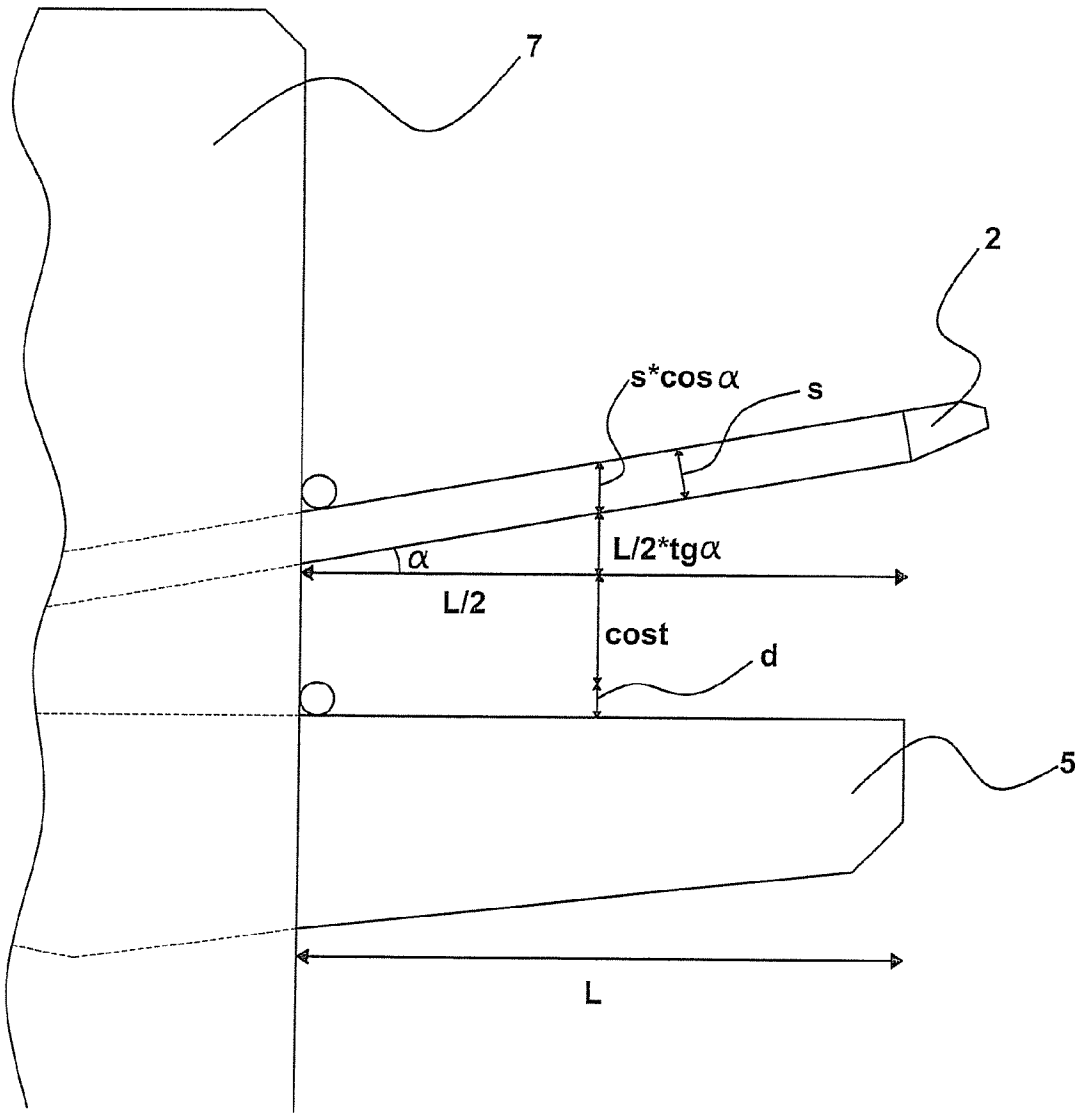
FIG. 8 shows two components of the aforesaid device in a starting position of the process cycle of the invention.

More specifically, the preferred average falling or unloading height $H_m$ of the bars from the lances 2 to the bag 5, is defined by the following equation:

$$H_m = s^* \cos \alpha + (L/2)^* tg\alpha + \text{cost} + d$$

where (FIG. 8):

"s" is the thickness of the depositing lances 2;

"L" is the extension, transversal to the bars, of the movable bag 5, i.e. the width of the movable bag measured from the first vertical backing 7 to the end;

"cost" is a constant in the range from 0 to 100 mm, preferably equal to about 30 mm;

"d" is the diameter of the bars.

If "cost" is equal to zero:

$$H_m = s^* \cos \alpha + (L/2)^* tg\alpha + d.$$

Once one layer of bars has been unloaded from the lance 2 to the movable bag 5, the latter is lowered by a fixed height equal to at least the thickness-diameter of the bars, so as to always allow the free movement of the lances 2; this lowering is gradually executed up to reach the required number of layers in relation to the desired final dimension of the bundle to be formed. However, the falling height of the bars on the accumulated layers underneath is substantially unchanged.

Once the formation of the bundle has been completed, the movable bag 5 lowers at the roller table 6 underneath (position 5' in FIG. 1), deposits the bundle on the motorized horizontal rollers 6' and moves back up to the initial position immediately below the lances 2. Immediately after the transfer of the bundle to the roller table, the movable bag advantageously rotates by 90° downwards to a substantially vertical position 5" (FIG. 1): the interference with the just deposited bundle is thus prevented during the bag upward movement. The bag may thus move up without needing to wait for the bundle itself being evacuated. During the return stroke to the starting position, the bag rotates and is gradually returned to the horizontal position.

More specifically, during the step of depositing the bars, the lances 2 are in a first maximum advancement position, adjacent to the terminal end of the conveyor 4, to receive the bars 3 which are unloaded from the conveyor itself due to the gravity.

By virtue of the inclination of lances 2, the bars descends due to the gravity rolling around the axis thereof along the upper surfaces of the lances themselves. The first bar unloaded onto the lances rolls until it stops at the first frontal backing 7, which serves a containing function; the next unloaded bars will roll down to be arranged side-by-side and form a first uniform layer on the lances.

Once the first bar layer has been formed, the lances 2 are retracted in a very quick manner to a second maximum retraction position in order to make this first layer of bars fall onto the movable bag 5 underneath.

According to a first aspect of the bundle forming process of the invention, the retraction speed of the depositing lances 2 is such to create a sort of "tablecloth effect", i.e. the resting surface of the bar is nearly instantaneously removed so that no dragging is caused upon the friction force at the bar-lance contact surfaces. During the step of lance unloading, this prevents bars from tangling and overlapping on both the lances themselves and the respective already accumulated layers underneath; by virtue of the tablecloth effect, bars simultaneously fall while maintaining parallel to one another, and on the movable bag 5 they will substantially have the same mutual position they firstly had on the lances.

Furthermore, the time interval needed for the lances to pass from the maximum advancement position to the maximum retraction position and then back to the maximum advancement position is advantageously shorter than the frequency at which the conveyor 4 feeds the bars 3, so that the bars may be continuously deposited on the lances without down-times or interruptions related to the step of unloading the bars already deposited on the lances. This time interval is preferably of about 1 second.

This procedure of unloading the lances substantially prevents all side movements, tangling or twisting of the bars, which are tidily unloaded onto the movable bag, thus forming bundles consisting of tidily overlapping layers of bars. The movable bag 5, cooperating with vertical backings 7, 8, is lowered to pass, with its resting surfaces, through the gap between the motorized rollers 6' in order to lay down the formed bar bundle on said rollers 6'. At this point, the motorized horizontal rollers 6' will transport the bar bundle to the binding area. The vertical idle rollers 6" advantageously contain the bundle in the final descending segment of the bag. In accordance with a second aspect of the process of the invention, the time taken by the movable bag 5 to lower and lay the bar bundle, once completed, on the roller table 6 and to return to the starting position for forming a new bundle is shorter than the cycle time in which the depositing lances 2 are filled with a new layer of bars. Therefore, the transfer of the bar bundle from the movable bag 5 to the roller table 6 is also carried out without ever requiring to interrupt the feeding of the bars by conveyor 4.

In accordance with a further aspect of the process of the invention, the conveyor 4 which feeds the bars 3 to the depositing lances 2 is suitable for advantageously keeping a determined distance between the moved bars and may consist, for example, of either a worm-screw transferring device (FIGS. 1 and 3), or a cooling plate with fixed and movable tooth racks (FIG. 4), or a combination of said devices (FIG. 5). Keeping the bars physically separate from one another, before unloading them onto the lances, contributes to a precise, tidy formation of layers on the lances, without undesired tangling. Said conveyor may also feed the bars 3 in twos to the depositing lances 2, advantageously keeping a determined distance between the moved bar pairs.

Using the cooling plate has the further advantage of allowing the temperature of the bars to lower, thus increasing the stiffness thereof before unloading for the benefit of straightness.

Figure 6:
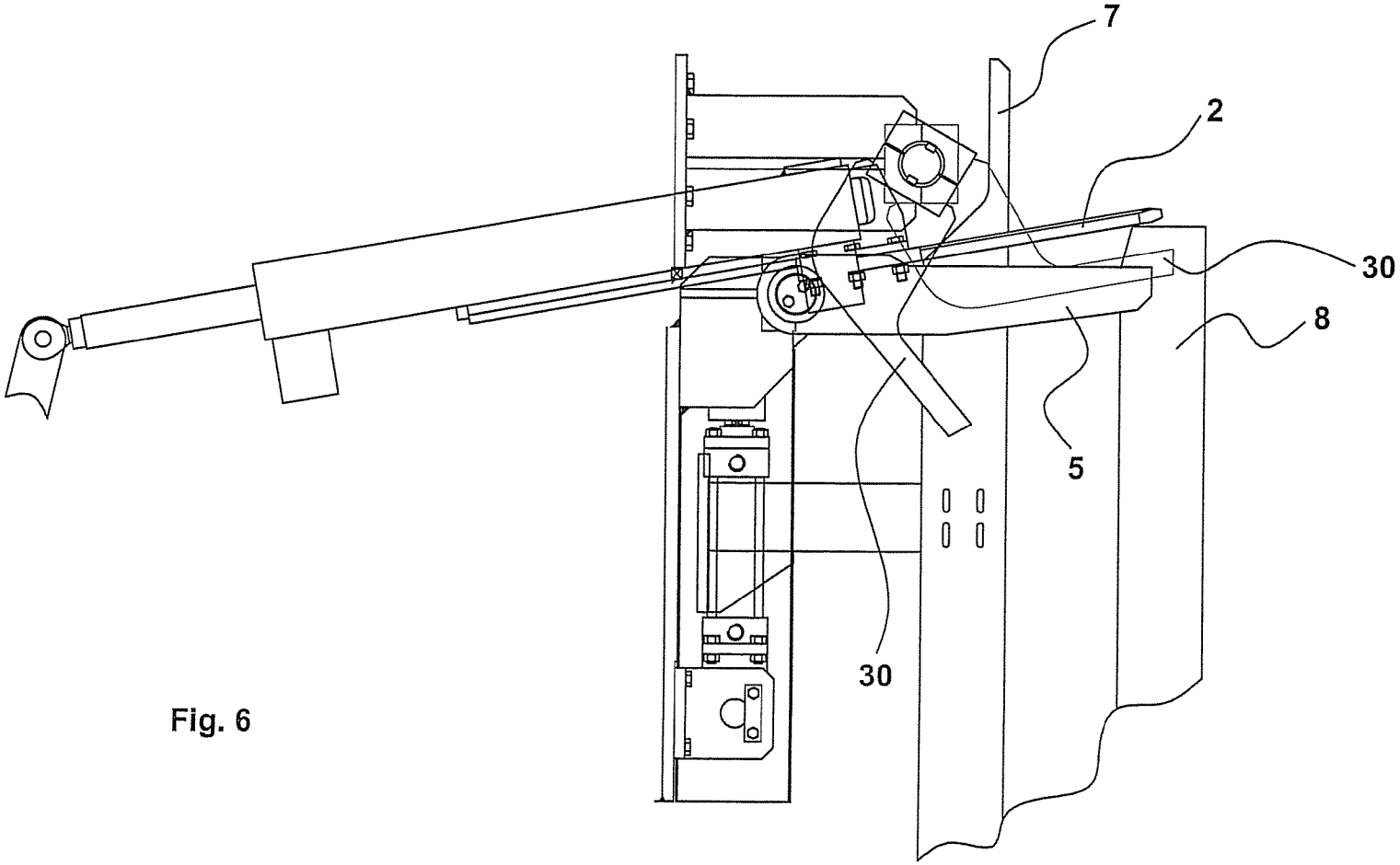
FIG. 6 is a side view of part of a first embodiment of the device of the invention.

According to a embodiment of the device of the invention, there is provided the use of an additional bag or accumulator 30, shown in FIG. 6, which may be activated in a predetermined instant of the cycle and adapted to be placed immediately below the depositing lances 2 when the movable bag 5 starts to transfer the bundle formed towards the roller table 6. Said additional bag 30 receives a first layer of bars 3 from the depositing lances 2, in the same manner as the movable bag 5, and then delivers it to the movable bag 5, which in the meantime is returned to its starting position.

The configuration of the additional bag is such to deliver this first layer of bars to the movable bag 5 by simply resting said layer on the horizontal resting surfaces of the bag 5. At this point, the additional bag moves clear and the other bar layers are unloaded again onto the movable bag 5 and the cycle continues as described above. Therefore, said additional bag acts as a buffer-plenum. Using this additional bag is particularly advantageous in the case in which, for installation and layout requirements, the laying plane of the conveyor 4 is rather higher than the laying plane of the roller table 6, not allowing the movable bag 5 to be able to return to the starting position in time to unload a new first layer of bars from the lances due to the longer path to be covered, the time for forming the layer on the lances being the same.

Figure 7:
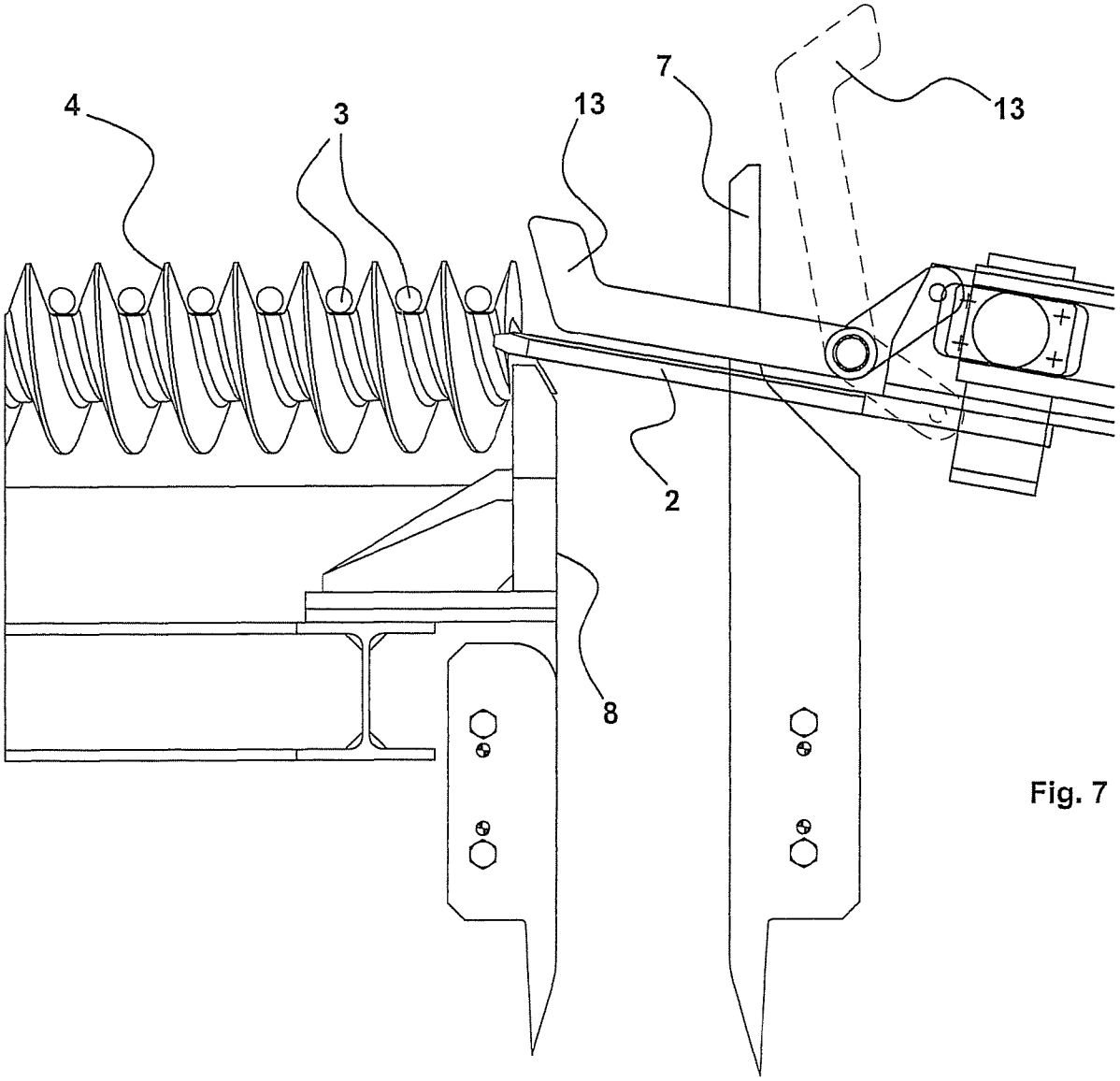
FIG. 7 is a side view of part of a second embodiment of the device of the invention.

According to a further embodiment of the device of the invention, there is provided the use of a movable backing 13, shown in FIG. 7, hinged onto the same frame of the lances 2 and cooperating with the lances themselves. Said backing element 13, by rotating about the pin 14, is adapted to be placed with a surface thereof parallel to the upper surfaces of the lances 2 at a predetermined distance in function of the diameter of the bars. This distance is slightly larger than the diameter value of the bars so as to prevent any bar tangling, thus proceeding in ensuring the perfect alignment and arrangement side-by-side of the bars themselves. Using this movable backing element 13 is particularly advantageous when the final size of the bundle to be produced is considerable, whereby a greater distance between the fixed vertical backings 7, 8 and a longer length of the depositing lances 2 are required. Therefore, it may occur that due to the inertias and physical limits of the moving kinematic mechanism, the lances are not able to retract fast enough to create the so-called "tablecloth effect". A further embodiment of the device of the invention may include both the movable backing element 13 and the additional bag.

The invention claimed is:

1. A device for forming a rolled bar bundle, adapted to cooperate with an end of a conveyor of said bars, the conveyor defining a first plane, the device comprising:

a plurality of transversal supporting elements, arranged on a second plane and parallel to one another, moving means adapted to move the plurality of transversal supporting elements along said second plane from a first receiving position adjacent to said end of the conveyor, in which the supporting elements are placed during a step of receiving a predetermined number of bars which are unloaded from the conveyor for forming a layer of bars on said supporting elements to a second unloading position in order to unload said layer of bars onto accumulation seat at a speed such to prevent the bars resting on said supporting elements from being dragged, first containing means of said layer of bars cooperating with said plurality of supporting elements, wherein the second plane is inclined by an angle ($\alpha$), with respect to said first plane, in the range from 1° to 20° whereby the bars unloaded by the conveyor are caused to descend due to the gravity, rolling around an axis thereof, along upper surfaces of the supporting elements to be arranged side-by-side and form a uniform layer of bars on said supporting elements said uniform layer being contained by said first containing means.

2. A device according to claim 1, wherein the accumulation seat are placed in a first position thereof at a distance underneath the transversal supporting elements so that the average unloading height ($H_m$) for the bars, from said elements to said accumulation seat, is defined by the following equation:

$$H_m = s^* \cos\alpha + (L/2)^* tg\alpha + \text{cost} + d$$

where:

"s" is the thickness of the transversal supporting elements, "L" is the transversal extension of the accumulation seat "cost" is a constant in the range from 0 to 100 mm, "d" is the diameter of the bars.

3. A device according to claim 2, wherein there are provided lubrication means for lubricating the upper surface of the transversal supporting element.

4. A device according to claim 3, wherein said lubrication means comprise a solid graphite applicator for each transversal supporting element.

5. A device according to claim 3, wherein the accumulation seat comprises a plurality of horizontal resting surfaces, spaced from one another, each resting surface being at a respective transversal supporting element (2).

6. A device according to claim 5, wherein the accumulation seat cooperates with said first containing means and with second containing means opposite to the first and substantially placed below the terminal end of the conveyor and are adapted to be moved from said first position to a second position thereof at a roller table underneath.

7. A device according to claim 6, wherein said roller table consists of motorized horizontal rollers and idle vertical rollers and the resting surfaces of the accumulation means are adapted to pass through a gap between the motorized rollers so as to rest the bundle on said motorized rollers.

8. A device according to claim 6, wherein there is provided an additional accumulation seat adapted to be placed immediately below the plurality of transversal supporting elements when said accumulation seat start transferring the formed bundle to the roller table.

9. A device according claim 8, wherein there is provided a movable backing element hinged to a same frame of the transversal supporting elements and cooperating with said elements, adapted to be placed with a surface thereof parallel to the upper surfaces of the transversal supporting elements.

10. A process for forming rolled bar bundles, by means of a device according to claim 1, comprising the following stages:

a) providing the plurality of transversal supporting elements in the first receiving position;

b) receiving in said first receiving position a predetermined number of bars on said second inclined plane whereby the bars unloaded by the conveyor are caused to descend due to the gravity, rolling around an axis thereof, along upper surfaces of the supporting elements to be arranged side-by-side and form a uniform layer of bars on said supporting elements said uniform layer being contained by the first containing means c) moving said plurality of supporting elements from the first receiving position to the second unloading position, for unloading said uniform layer of bars on the accumulation seat at a speed such that resting surfaces of the bars are instantaneously removed whereby dragging is avoided upon the friction force at bar-support element contact surfaces and whereby the bars simultaneously fall, while maintaining parallel to one another, on the accumulation seat where said bars will have the same mutual position they firstly had on the supporting elements.

11. A process according to claim 10, wherein during the step b) the bars are fed at least one at a time by means of the conveyor with a first predetermined time interval between the feeding of at least one bar and the feeding of at least one subsequent bar, and the movement of said plurality of supporting elements from the first receiving position to the second unloading position and from this second position back to the first receiving position occurs in a second time interval shorter than the first interval.

12. A process according to claim 11, wherein said second time interval is of about 1 second.

13. A process according to claim 12, wherein each time that a layer of bars is unloaded from the transversal supporting elements onto the accumulation seat the latter are gradually lowered by a height equal to at least the thickness-diameter of one bar.

14. A process according to claim 13, wherein once the formation of the bundle has been completed, the accumulation seat are lowered at a roller table underneath and deposit the bundle thereon.

15. A process according to claim 14, wherein once the bundle has been deposited on the roller table the accumulation seat rotates by 90° downwards to avoid the interference with the just deposited bundle during the step of moving upwards.

* * * * *